US006635851B2

(12) United States Patent
Uhl

(10) Patent No.: US 6,635,851 B2
(45) Date of Patent: Oct. 21, 2003

(54) PROCESS AND CIRCUIT FOR HEATING UP A GLOW PLUG

(75) Inventor: Günther Uhl, Ludwigsburg (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 09/874,320

(22) Filed: Jun. 6, 2001

(65) Prior Publication Data

US 2001/0050275 A1 Dec. 13, 2001

(30) Foreign Application Priority Data

Jun. 7, 2000 (DE) ..... 100 28 073

(51) Int. Cl.[7] ..... F23Q 7/00
(52) U.S. Cl. ..... 219/270; 219/544; 123/145 A
(58) Field of Search ..... 219/270, 544; 123/145 A, 145 R; 361/264–266

(56) References Cited

U.S. PATENT DOCUMENTS

| | | | | |
|---|---|---|---|---|
| 4,658,772 A | | 4/1987 | Auth et al. | |
| 4,858,576 A | * | 8/1989 | Jeffries et al. | 123/145 A |
| 5,469,819 A | | 11/1995 | Berger et al. | |
| 6,148,258 A | * | 11/2000 | Boisvert et al. | 123/145 A |

FOREIGN PATENT DOCUMENTS

| | | | | |
|---|---|---|---|---|
| DE | 3123977 | * | 5/1982 | 123/145 A |
| DE | 198 09 399 A1 | | 2/1999 | |
| EP | 315934 | * | 5/1989 | 123/145 A |
| GB | 2 280 759 A | | 2/1995 | |
| JP | 58-135372 | * | 8/1983 | 123/145 A |
| JP | 62-7944 | * | 1/1987 | 123/145 A |
| JP | 63-266172 | * | 11/1988 | 123/145 A |

* cited by examiner

*Primary Examiner*—John A. Jeffery
(74) *Attorney, Agent, or Firm*—Nixon Peabody LLP; David S. Safran

(57) ABSTRACT

Process and circuit for heating up a glow plug of a given glow plug type in a given arrangement in an internal combustion engine to a predetermined temperature. The power supply voltage is on the glow plug via a measurement resistor (12) and a switch (11). A control and regulation unit (16) taps the voltage drop via the measurement resistor (12) and determines the heat energy supplied to the glow plug therefrom and from the likewise tapped voltage on the glow plug. The signal which occurs on the output (15) of the unit (16) controls the switch (11). After closing the switch (11) the unit (16) supplies the glow plug with heat energy which is added up in the unit (16). As soon as the heat energy which is required for heating up to a predetermined temperature and which is determined beforehand from the known parameters of the glow plug and from the starting temperature is reached, the switch is opened again via the output signal at the output (15).

2 Claims, 1 Drawing Sheet

PROCESS AND CIRCUIT FOR HEATING UP A GLOW PLUG

BACKGROUND OF THE INVENTION

The invention relates to a process and circuit for heating a glow plug of a given glow plug type in a given arrangement in an internal combustion engine to a predetermined temperature.

Glow plugs are used for example in diesel engines for igniting the fuel during starting or also for ion current acquisition in the combustion chamber of a diesel engine.

So that one such glow plug can perform its function, in a heat-up phase it must be heated to a certain temperature.

Glow plugs are known which have self-regulating heat-up characteristics. They are connected time-controlled to a power supply voltage and as a result of their self-regulating behavior they are heated up to a certain temperature.

Electronic control of the heat-up of the glow plug is also known. In this case the electrical power supply to the glow plug is controlled via an electronic control circuit such that the stipulated determined temperature is reached as quickly as possible and is not exceeded.

The known processes of self-regulation and electronic control however fail when the glow plug is to be heated very quickly to a high temperature, for example in two seconds to 1000° C. In electronic control for example this is due to the fact that as a result of the high dynamics of the heat-up process, with consideration of the manufacturing tolerances, major problems arise since under all circumstances overheating of the glow plug, even if only brief, must be avoided.

The object of the invention is therefore to devise a process and a circuit for heating up a glow plug with which heat-up to a relatively high temperature within a very short time interval can be achieved.

SUMMARY OF THE INVENTION

This object is achieved in the process of the invention where the heat energy needed for heat-up to a predetermined temperature is determined from the parameters of the respective glow plug type in a given arrangement and from the initial temperature of the glow plug, and the heat energy is supplied to the glow plug within a selected heat-up time interval.

One preferred embodiment of the process comprises heating up a glow plug of in an internal combustion engine to a predetermined temperature within a chosen heat-up time interval using the glow plug type and initial temperature of the glow plug to determine the heat energy needed.

A circuit for heating up the glow plug in an internal combustion engine comprises a power supply voltage across the glow plug in a series circuit with a switch, a measurement resistor, and an electronic control and evacuation unit. The required heat energy is supplied to the glow plug within a chosen heat-up time interval.

Using the pertinent drawings one especially preferred embodiment of the invention is described below.

DETAILED DESCRIPTION OF THE INVENTION

Figure 1:
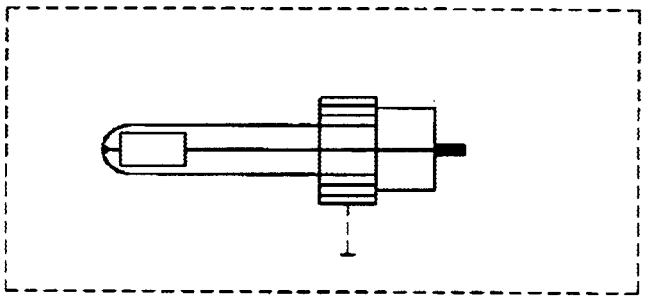
FIG.1 (PRIOR ART)
FIG. 1 shows in a schematic one embodiment of a known steel glow plug for igniting the fuel mixture in a diesel engine.

In the known steel glow plug 1 which is shown in FIG. 1, an electrically operated heating means 4 is embedded in a glow tube 3. The glow tube 3 sits in a glow plug body 5 via which the glow plug 1 is screwed into the engine block. Current is supplied to the electrical heating means 4 via an electrical terminal 7 which is connected to the electrical heating means 4. The second electrical terminal of the heating means 4 is connected to the glow tube 3 so that the circuit is closed to the ground 8 via the glow tube 3 and the glow plug body 5.

The glow plug 1 can also be made as a ceramic glow plug in which the glow tube 3 and the heating means 4 are made in the form of a unit as a ceramic heating element.

Figure 2:
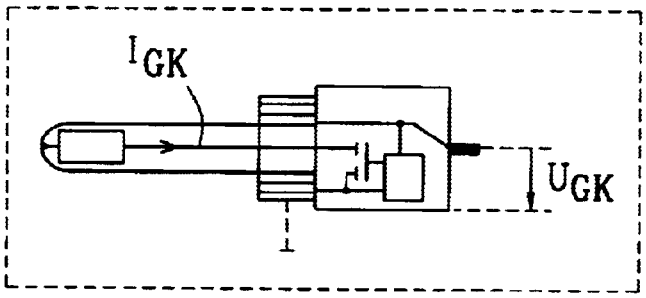
FIG.2 (PRIOR ART)
FIG. 2 shows in a schematic a known steel glow plug which is used as a measurement electrode for ion current acquisition in a diesel engine.

The glow plug 2 shown in FIG. 2 is a steel glow plug which is made electrically insulated for ion current acquisition in the combustion space of an internal combustion engine. The glow tube 3 is arranged electrically insulated relative to the plug body 5 and is used as the measurement electrode in ion current acquisition. In the glow plug 2 there are a semiconductor switch 9 and a voltage evaluation circuit 10 which, depending on the voltage on the glow plug 2, moves the semiconductor switch 9 into the conductive state, or for ion current acquisition into the blocked state.

In a glow plug with a self-regulating heat-up characteristic, heat-up takes place in the conventional manner by the glow plug being generally placed in a time-controlled manner at the power supply voltage. As a result of the self-regulating behavior the tip of the glow plug is heated to the temperature stipulated by the mechanical and electrical dimensioning. The self-regulating heat-up characteristic can be achieved for example by the heating means being made of a heating spiral and a control spiral. These spirals are connected in series. The heating spiral consists of a material with a negligibly small temperature coefficient, while the control spiral consists of a material with a distinct temperature coefficient. Current flowing through the heating and the control spirals causes the two spirals to be heated. The control spiral in doing so increasing its resistance so that the current intensity reduces the current flowing through the heating and control spirals. In doing so an equilibrium state is formed in which the glow plug remains at a constant stipulated temperature.

The heat-up of the glow plug can also proceed electronically controlled, in this case the electrical power supplied to the glow plug being controlled via an electronic control circuit such that a stipulated temperature is reached as quickly as possible and is not exceeded. When the heating means is made of a material with a known resistance temperature behavior, the resistance and thus the temperature of the heating means can be determined from the current and voltage measurement.

The known self-regulating processes or electronic controls however cannot be used when a glow plug is to be heated up very quickly to a high temperature, for example, within two seconds to 1000° C.

In the invention process therefore power control is not used, but the heat-up of the glow plug takes place energy-controlled by ascertaining the heat energy required for heat-up to a predetermined temperature being determined from the parameters of the respective glow plug type in a given arrangement and from the initial temperature of the glow plug and supplying it to the glow plug within a chosen heat-up time interval.

Here it is assumed that under known initial conditions the same heat energy is always required to heat up a glow plug of the same glow plug type to the desired final temperature, i.e. the predetermined temperature. These initial conditions are the starting temperature, the cooling conditions and the heat capacity of the area of the glow plug to be heated up, which can be a delineated area of the glow plug, i.e. the glow tube and mainly the glow plug tip. This area has a defined heat capacity. The cooling conditions are determined by the arrangement or the installation of the glow plug in the engine and can be determined by computation or measurement. The heat capacity of the glow plug, i.e. its area to be heated on the glow plug tip, is determined by the geometry and the material properties and can likewise be determined by computation or by measurement. In doing so it can be assumed that with respect to the production of glow plugs in large numbers the cooling conditions and the heat capacity of glow plugs of the same glow plug type are subject to only minor variations.

This results in that the energy demand for heating up the glow plug from a starting temperature to the desired or predetermined final temperature can be determined by measurement and/or by computation and that in glow plugs of the same glow plug type in the same arrangement, heat-up can be controlled such that in the heat-up phase the same predetermined heat energy which is determined by measurement or computation and which is required for heating up the glow plug to a predetermined temperature is always supplied. Other required heat energies can be assigned to other starting or final temperatures. When the supply of heat energy is electronically controlled, the supply of heat energy over time, i.e. the consumption of electric power, can be optionally controlled. For example, the power consumption can be kept constant, or first more and then less, or vice versa, power can be supplied.

Figure 3:
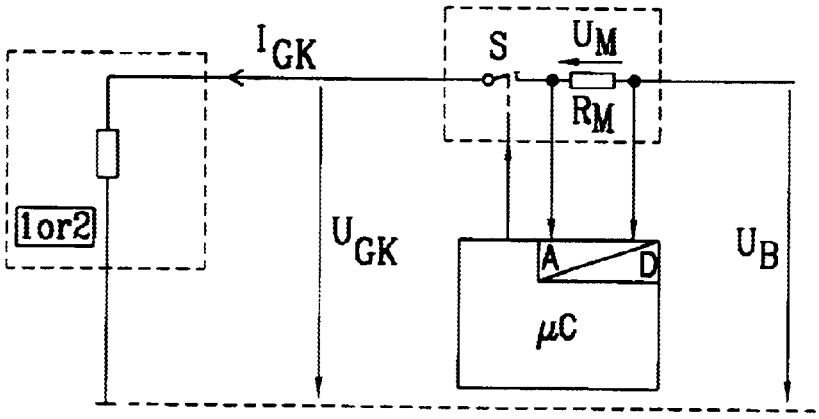
FIG. 3 shows in a schematic the embodiment of the circuit in the invention for heating up a glow plug.

FIG. 3 shows in a schematic arrangement one embodiment of the arrangement of the invention for heating up a glow plug of a given glow plug type in a given arrangement to a predetermined temperature.

A glow plug 1, 2, of the type shown in FIG. 1 or 2 is connected via a switch S11 and a current measuring resistor $R_M$12 to the power supply voltage $U_B$. Thus a voltage $U_M$ which is proportional to the glow plug current $I_{GK}$ can be tapped via the resistor $R_M$12 on the taps 13, 14. Moreover the voltage $U_{GK}$ on the glow plug can be measured via the tap 14. The tapped voltages are on a control and evaluation unit 16 which can be made for example in the form of a microprocessor with an integrated analog/digital converter. This control and evaluation unit 16 controls the switch 11 via its output signal 15. The combination of the switch 11 and the current measuring resistor 12 is preferably made as a fully integrated power semiconductor with a load current signal output.

The above described circuit works as follows.

To heat up the glow plug, a signal for closing the switch 11 is applied via the control and evaluation unit 16. In this way the power supply voltage $U_b$ is on the glow plug. The overall heat-up time interval is for example divided into individual, short component time intervals $T_0$ and the voltage $U_A$ on the glow plug and its power consumption $I_{GK}$ are determined via the taps 13, 14. The component time interval $T_0$ can be small and can be for example less than 1 ms. It is assumed that within one such short time interval $T_0$ the current $I_{GK}$ which is consumed by the glow plug remains constant. The energy $E_{T0}$ supplied in the component time interval $T_0$ can be determined as:

$$E_{TO}=U_{GK}\times T_{GK}\times T_0$$

The heat energy supplied overall is obtained then by adding up these individual heat energies in the short component time intervals $T_0$.

The supply of heat energy can be controlled by for example the overall heat-up time interval being divided into ten component time intervals $T_0$ and the switch 11 being closed not in all ten time intervals $T_0$, but for example only in three of the ten time intervals, so that the glow plug at constant energy supply per time interval is supplied with only 30% of the maximum possible heat energy. That is, in other words, that to heat up the glow plug the component amount of heat energy supplied in each component time interval is determined and is added up and the switch 11 remains closed until the required predetermined total heat energy is reached which is needed to heat up the glow plug to the predetermined temperature.

It goes without saying that in the process and the circuit of the invention, for example a corresponding choice of the heat-up time and/or the type of supply of heat-up energy precludes damage to the glow plug by the heat output which occurs when heat energy is supplied.

For this purpose, provisions are made for a stipulated boundary value of the maximum temperature of the heating element in the glow tube of the glow plug, for example the heating and control spirals, not being exceeded below its melting point. The arrangement of the heating element within the glow tube and the embedding of the heating element in the glow tube are one possible embodiment which represents a thermal lowpass in which during rapid heat-up the temperature of the heating element rises much more quickly compared to the temperature of the glow tube. Energy supply during rapid heat-up is controlled such that the temperature of the heating element never exceeds the stipulated boundary value. This lowpass behavior of the glow plug is dictated by its structure. In this way the energy-time or power-time profile which prevents overheating the heating element during rapid heat-up can be established.

What is claimed is:

1. Process for heating up a glow plug of a given glow plug type in a given arrangement in an internal combustion engine to a predetermined temperature in a pre-heat up phase prior to engine operation, characterized in that the heat energy which is needed for heat-up to a predetermined temperature in a heat-up phase is determined from the physical characteristics of at least shape and material properties of the respective glow plug type in the given arrangement and from the initial temperature, and based on the heat energy determination, and the determined heat energy is supplied to the glow plug within a chosen heat-up time interval.

2. Process as claimed in claim 1, wherein the heat-up time interval is divided into component time intervals and the heat energy transmitted to the glow plug in the respective component time intervals is determined and added up.

* * * * *